US010905265B1

(12) United States Patent
Warner

(10) Patent No.: US 10,905,265 B1
(45) Date of Patent: Feb. 2, 2021

(54) DEVICE FOR TARGETED DISPENSING OF NOURISHING MICROCAPSULES TO SKIN DURING SLEEP

(71) Applicant: Katya Warner, St. Petersburg, FL (US)

(72) Inventor: Katya Warner, St. Petersburg, FL (US)

( * ) Notice: Subject to any disclaimer, the term of this patent is extended or adjusted under 35 U.S.C. 154(b) by 0 days.

(21) Appl. No.: 16/775,694

(22) Filed: Jan. 29, 2020

(51) Int. Cl.
*A47G 9/10* (2006.01)
*A47G 9/00* (2006.01)

(52) U.S. Cl.
CPC ..... *A47G 9/10* (2013.01); *A47G 9/007* (2013.01); *A47G 2009/1018* (2013.01)

(58) Field of Classification Search
CPC ..... A47G 9/007; A47G 9/10; A47G 9/145; A47G 2009/1018; A61G 7/05792; A61G 7/072
See application file for complete search history.

(56) References Cited

U.S. PATENT DOCUMENTS 233,954 A * 11/1880 Thompson ..... A61M 16/06 128/202.18
2,750,606 A * 6/1956 Freedlander ..... A47G 9/10 5/636
4,050,417 A * 9/1977 Ellis ..... A01K 13/003 119/656
4,826,479 A * 5/1989 Burgin ..... A47G 9/007 5/636
4,852,517 A * 8/1989 Smith ..... A01K 13/003 119/28.5
4,882,220 A 11/1989 Ono et al.
5,038,431 A * 8/1991 Burgin ..... A47G 9/007 119/28.5

(Continued)

FOREIGN PATENT DOCUMENTS

EP 0955043 B1 11/1999
EP 1923423 A1 5/2008
EP 2731564 B1 5/2014

OTHER PUBLICATIONS

Camphor: Uses, Side Effects, Interactions, Dosage, and Warning; WedMD; Mar. 31, 2020; https://www.webmd.com/vitamins/ai/ingredientmono-709/camphor (Year: 2020).*

*Primary Examiner* — Nicholas F Polito
(74) *Attorney, Agent, or Firm* — Larson & Larson, P.A.; Justin P. Miller; Frank Liebenow

(57) ABSTRACT

The dispensing device allows for application of nourishing compounds, such as microcapsules, during rest. The elements of the dispensing device that contain the nourishing compounds are separable from the body of the device. Thus, the body of the device is washable without risk of washing away the desirable compounds. The device can take one of multiple embodiments. In the first embodiment, a lower layer forms the body of the device. The body is preferably formed from a compressible material, such as memory foam or other types of polyurethane foam. The upper layer includes a multiplicity of internal reservoirs that contain the nourishing compounds and/or microcapsules. When a user places her head on the device, the downward force created against the relevant storage body pushes the compounds/microcapsules out of the internal reservoir, exiting through the orifices and into the user's skin.

15 Claims, 7 Drawing Sheets

(56) References Cited

U.S. PATENT DOCUMENTS

| | | | | |
|---|---|---|---|---|
| 5,127,367 | A * | 7/1992 | Starowitz, Jr. | A01K 1/0157 119/28.5 |
| 5,232,769 | A | 8/1993 | Yamato et al. | |
| 5,299,335 | A * | 4/1994 | Ivester | A47C 27/001 128/202.18 |
| 6,574,809 | B1 | 6/2003 | Rathbun | |
| 6,805,263 | B2 | 10/2004 | Garcia et al. | |
| 6,997,355 | B2 | 2/2006 | Duquet | |
| 7,082,633 | B1 | 8/2006 | Maarbjerg | |
| 7,805,787 | B2 * | 10/2010 | Wallis | A47C 31/005 5/641 |
| 8,161,588 | B1 | 4/2012 | Anson | |
| 8,192,841 | B2 | 6/2012 | Amundson et al. | |
| 8,468,628 | B1 * | 6/2013 | Cheng | A47G 9/007 5/641 |
| 9,220,275 | B2 | 12/2015 | Chetboun | |
| 9,408,419 | B2 | 8/2016 | Almario et al. | |
| 2004/0049854 | A1 * | 3/2004 | Schunk | A61G 7/057 5/655.5 |
| 2014/0271863 | A1 | 9/2014 | Anderson et al. | |
| 2015/0265063 | A1 * | 9/2015 | Cappadona | A47C 27/002 5/698 |
| 2017/0226668 | A1 * | 8/2017 | Kilickan | D03D 15/0027 |

* cited by examiner

DEVICE FOR TARGETED DISPENSING OF NOURISHING MICROCAPSULES TO SKIN DURING SLEEP

FIELD

This invention relates to the field of skin nourishment and more particularly to a device for focused and target dispensing of microcapsules.

BACKGROUND

As one ages, the skin becomes less able to create the compounds needed to maintain its health.

Oil production decreases, resulting in dryness. Fat layers thin, increasing the risk of damage.

Pigment production decreases, making skin more translucent.

Collagen and elastin concentrations reduce, with their absence allowing skin to stretch and drop.

These conditions are treatable through the application of nourishing compounds to the skin. But the application of the compounds is made difficult by practical realities—limited time to apply, missed reapplications, and the appearance of the skin when compounds have been recently applied.

What is needed is a device that will allow a user to easily apply nourishing compounds to the skin for extended periods of time, allowing the user to fully realize the beneficial effects.

SUMMARY

The dispensing device allows for application of nourishing compounds, such as microcapsules, during rest.

The elements of the dispensing device that contain the nourishing compounds are separable from the body of the device. Thus, the body of the device, and any associated cover, such as a pillowcase, is washable without risk of washing away the desirable compounds.

The device can take one of multiple embodiments.

In the first embodiment, a lower layer forms the body of the device. The body is preferably formed from a compressible material, such as memory foam or other types of polyurethane foam. Natural materials are also anticipated, such as wool, cotton, down, latex, and similar materials.

The upper layer includes a multiplicity of internal reservoirs that contain the nourishing compounds and/or microcapsules.

When a user places her head on the device, the downward force created against the relevant storage body/internal reservoir pushes the compounds/microcapsules out of the internal reservoir, exiting through the orifices and into the user's skin.

The internal reservoirs may be located at the desired areas, for example, at the cheek and neck, and only activated by direct pressure.

Alternatively, the reservoirs may be placed at remote locations, but activated by pressure against a central reservoir by the weight of the head.

Regardless of the chosen methodology, if microcapsules are used, the presence of a gas, preferably air, within the internal reservoirs is required.

If a gas is absent, the microcapsules may become lodged against each other and unable to exit through the orifices. Air inclusion creates space for capsules to be carried out.

The air may be introduced into the reservoirs by the deflation/inflation action of the reservoir/pouch as force is applied and released.

Or a mechanical device can introduce air, such as a pump. The pump can be a bellows that is actuated by weight of the user's head. Each reservoir can have its own bellows, or a single bellows can supply air to multiple reservoirs.

Optionally, the motive force for dispensing the micro capsules is created by a powered source, such as a fan. The fan is preferably electrical. The use of an electrical device allows for control of the dispensing speed without depending on the weight of the user's head. Additionally, other features, such as a timer, can be incorporated to control when compounds, or microcapsules, are dispensed.

Microcapsules are the combination of a small particle or droplet and a surrounding coating. Microencapsulation can enclose solids, liquids, or gases inside a thin wall referred to as a film or membrane. The film protects the contents, preventing degradation and changing the physical properties of the resulting substance by separating the liquid from the environment. Thus, the feel of the resulting microcapsules is different, and interactions are changed by, for, example, protecting the contents from oxygen.

The material inside the microcapsule is referred to as the core, internal phase, or fill, with the wall referred to as a shell, coating, or membrane.

Within the membrane are substances such as anti-oxidants, sunscreen, vitamins, retinoids, peptides, or other substances that nourish the skin.

Alternatively, or in addition, the substances can include compounds and chemicals for medical treatments, specifically compounds absorbed through the skin.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
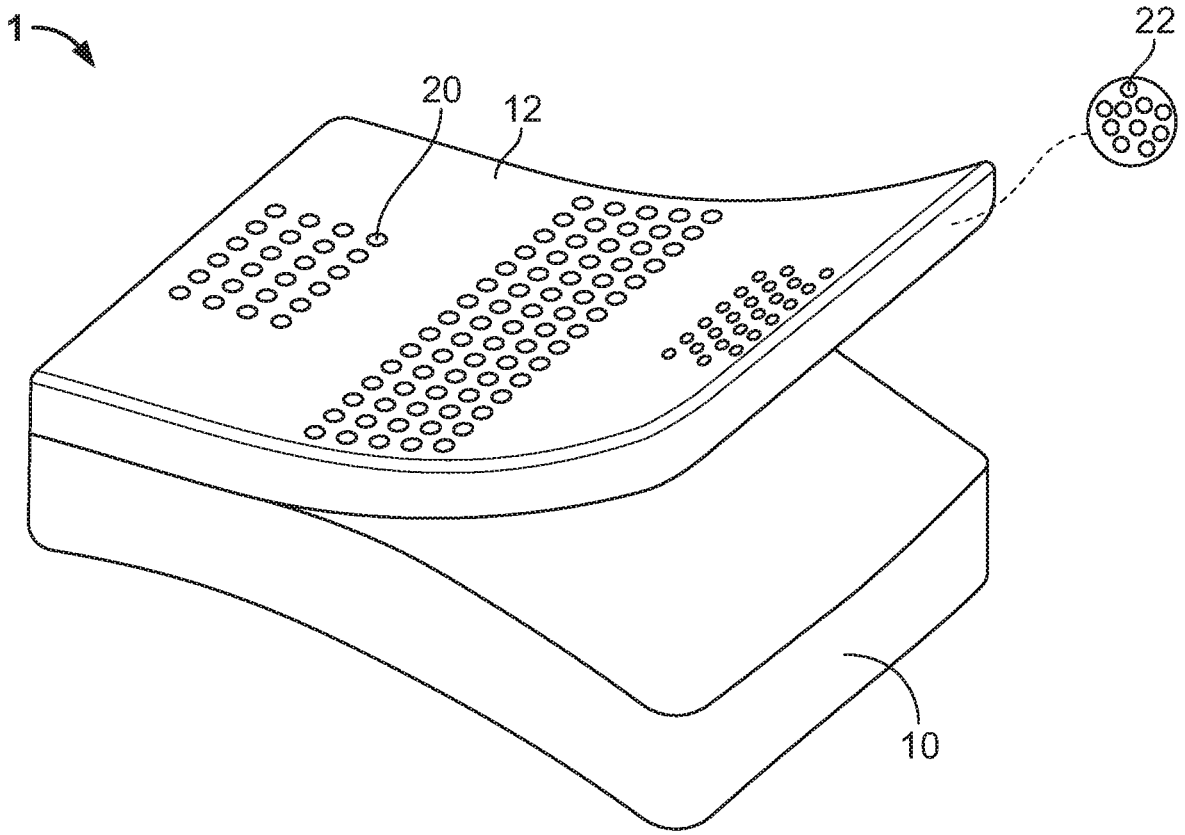
FIG. 1 illustrates an isometric view of a first embodiment of the dispensing device.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of a first embodiment of the dispensing device is shown.

The dispensing device 1 is shown formed from a body 10 supporting a dispensing layer 12. The dispensing layer 12 forms the entire top of the dispensing device 1, and includes a multiplicity of orifices 20 out of which microcapsules 22 may pass.

Figure 2:
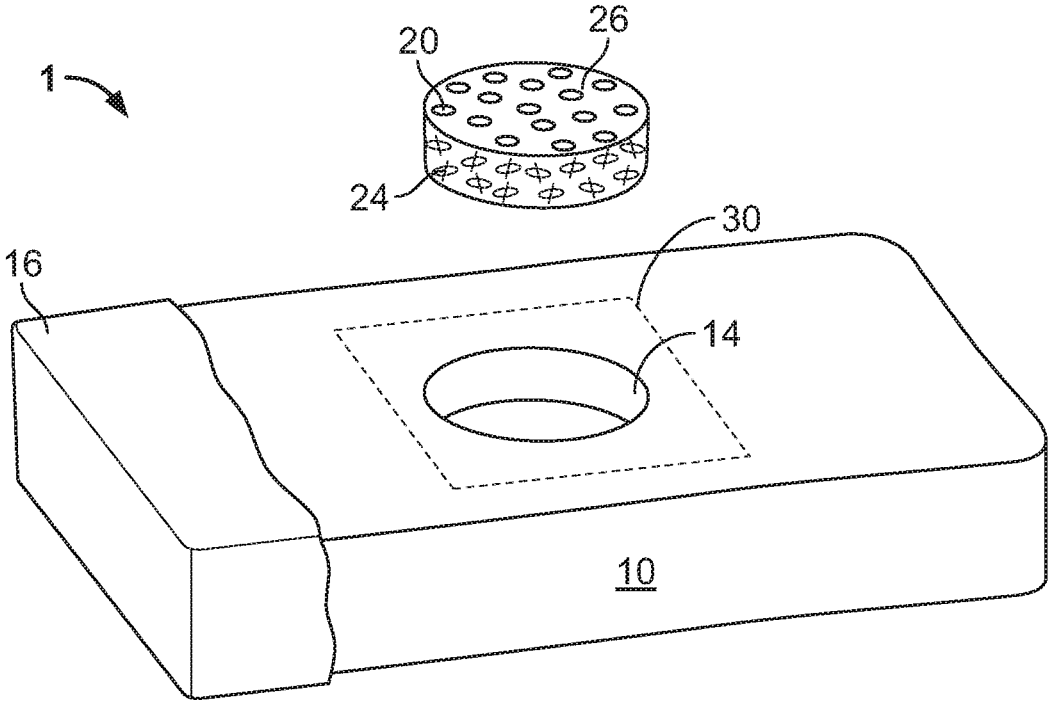
FIG. 2 illustrates an isometric view of a second embodiment of the dispensing device.

Referring to FIG. 2, an isometric view of a second embodiment of the dispensing device is shown.

The dispensing device 1 again includes a body 10, but in this embodiment includes a recess 14 into which a storage body 26 is placed. The storage body 26 includes internal reservoirs 24 inside of which are held microcapsules 22 (see FIG. 1), which exit through orifices 20.

The embodiment shown in FIG. 2 is a pillow, including a covering 16 or pillowcase.

The location of the recess 14 places the orifices 20 in a head and neck zone 30, thus providing microcapsules 22 (see FIG. 1) to the head and neck of a user.

Figure 3:
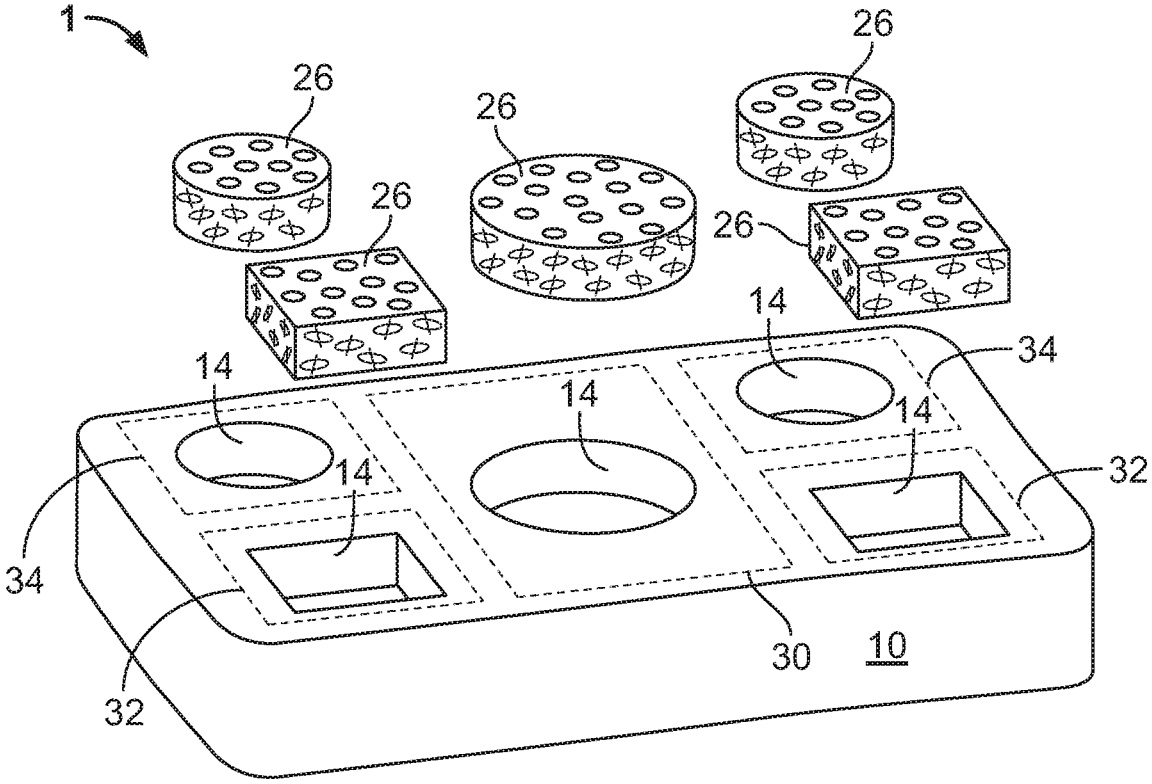
FIG. 3 illustrates an isometric view of a third embodiment of the dispensing device.

Referring to FIG. 3, an isometric view of a third embodiment of the dispensing device is shown.

In this embodiment, there are multiple recesses 14 into which storage bodies 26 are placed.

The result is storage bodies 26 directed to different parts of the user's head. The central storage body 26 is in a head and neck zone 30, with the adjacent storage bodies 26 forming a cheek zone 32 and forehead zone 34, with contact made when a user rolls her head to one side or the other.

Figure 4:
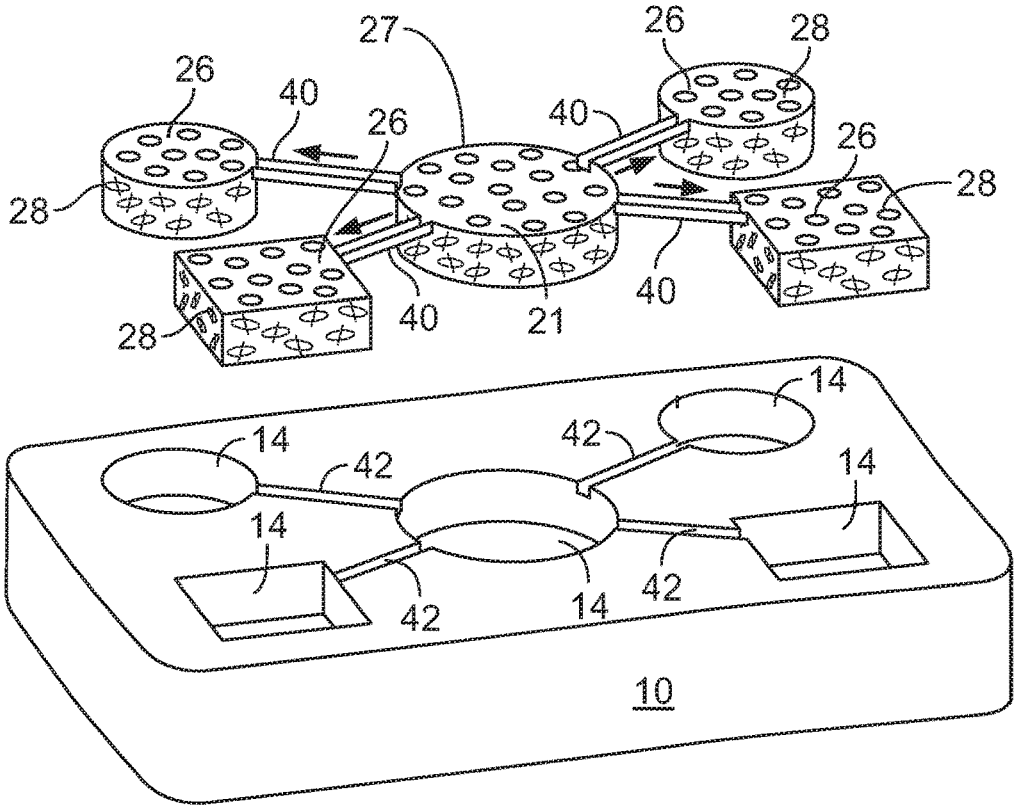
FIG. 4 illustrates an isometric view of a fourth embodiment of the dispensing device.

Referring to FIG. 4, an isometric view of a fourth embodiment of the dispensing device is shown.

In this embodiment, the recesses 14 are connected by branch recesses 42. The storage bodies 26 are divided into a central pouch 27 and multiple remote pouches 28. The central pouch 27 is initially charged or filled with nourishing compounds or microcapsules 22 (see FIG. 1), which are pushed from the central pouch 27 to the remote pouches 28 by the weight of the user's head.

Figure 5:
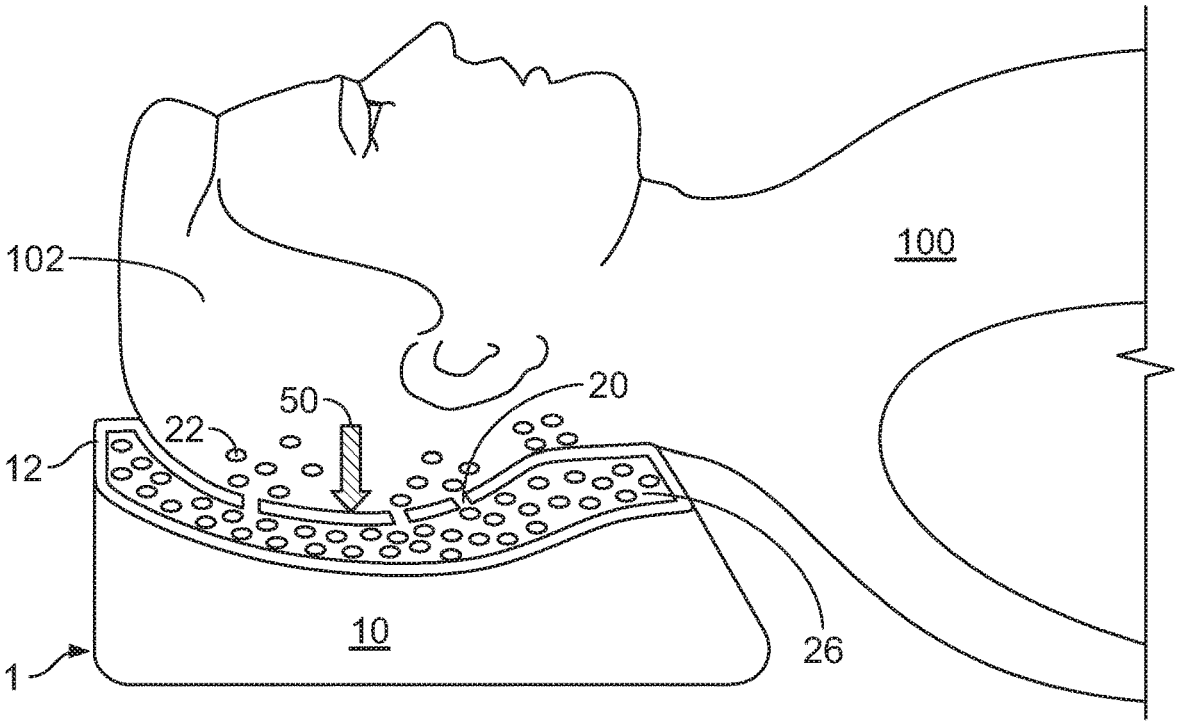
FIG. 5 illustrates a side cross-sectional view of an embodiment of the dispensing device.

Referring to FIG. 5, a side cross-sectional view of an embodiment of the dispensing device is shown.

The user 100 places his head 102 on the dispensing device 1, creating a force 50. Microcapsules 22 are pushed out of the reservoir 26 of the dispensing layer 12, through the orifices 20 and onto the user's head 102.

Figure 6:
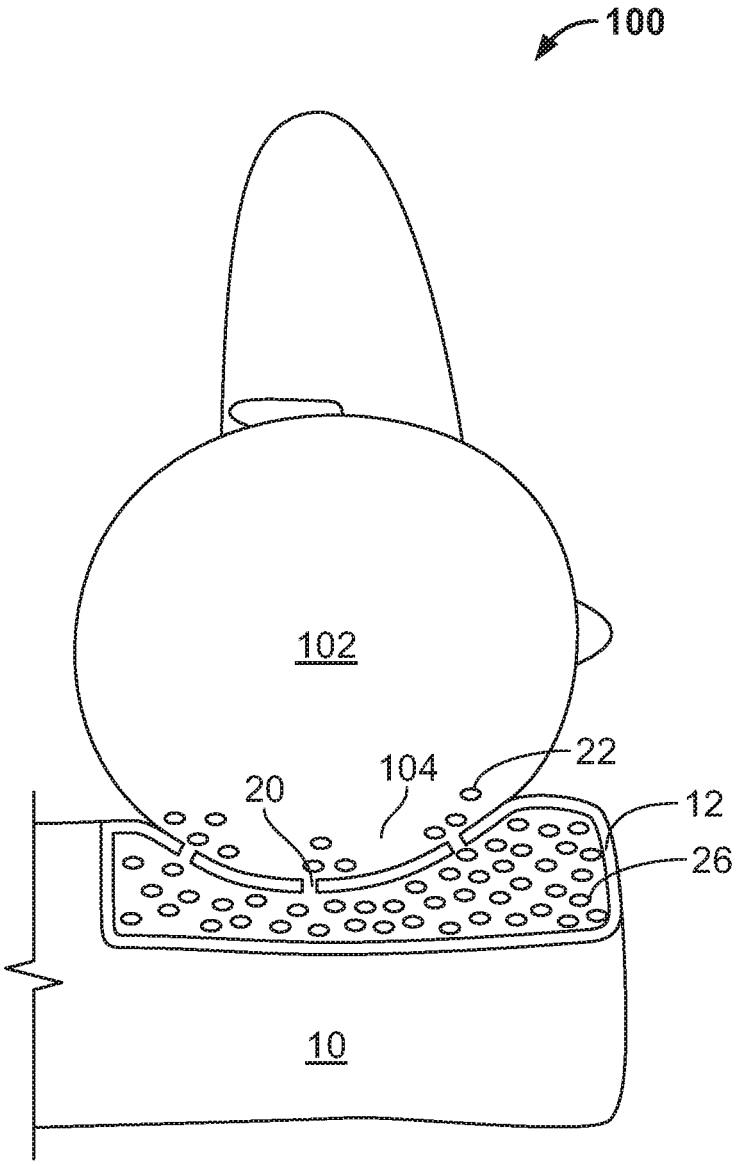
FIG. 6 illustrates a top cross-sectional view of an embodiment of the dispensing device.

Referring to FIG. 6, a top cross-sectional view of an embodiment of the dispensing device is shown.

The user 100 has now rolled on his side, placing his cheek 104 of his head 102 on the dispensing device 1. Again, microcapsules 22 are pushed out of the reservoir 26 of the dispensing layer 12, through the orifices 20 and onto the user's head 102.

Figure 7:
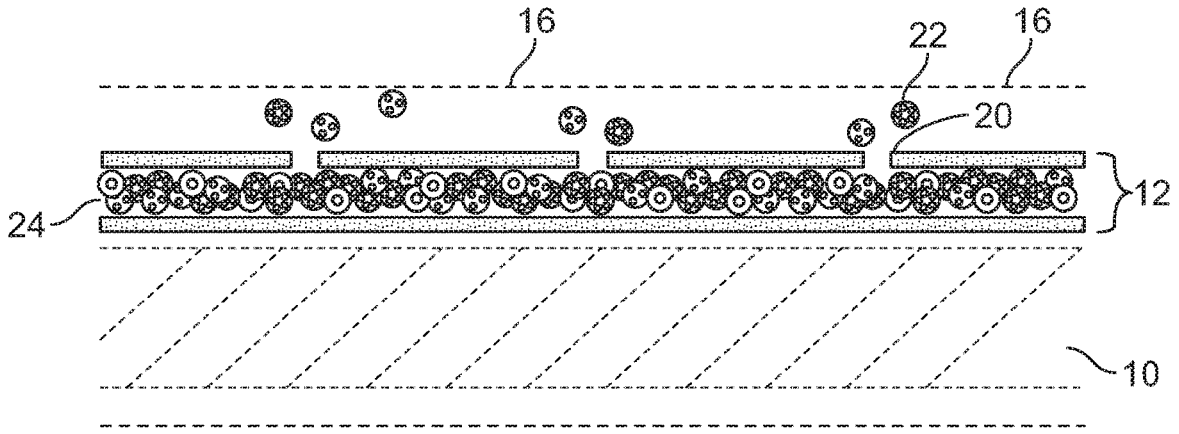
Referring to FIG. 7, a detail view of an embodiment of the dispensing device is shown.
Figure 8:
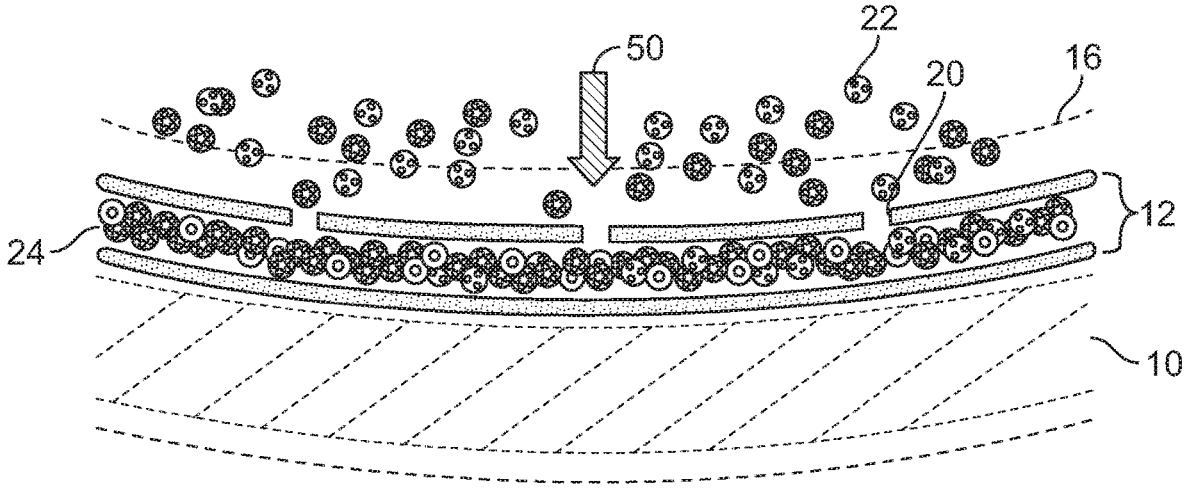
Referring to FIG. 8, a detail view of an embodiment of the dispensing device after a force is applied is shown.

Referring to FIGS. 7 and 8, detailed views of an embodiment of the dispensing device are shown.

The body 10 supports a dispensing layer 12, with a covering 16 above.

Microcapsules are held within the internal reservoir 24. When a force 50 is applied, such as from a user's head, the microcapsules 22 are forced out of the orifices 22, and through the covering 16.

Figure 9:
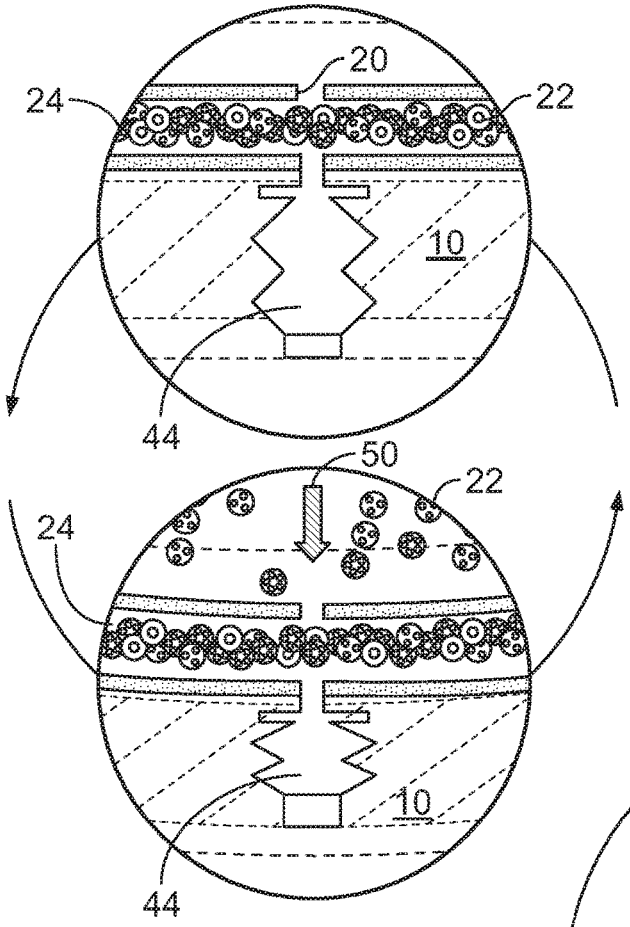
FIG. 9 illustrates a detail view of an embodiment of the dispensing device with a manual dispensing mechanism.

Referring to FIG. 9, a detail view of an embodiment of the dispensing device with a manual dispensing mechanism is shown.

When a force 50 is applied, the mechanical dispenser 44 pushes air upward, carrying microcapsules 22 from the reservoir 24 out through the orifice 20.

When the force 50 is released, the mechanical dispenser refills, preparing itself for the next force 50.

Figure 10:
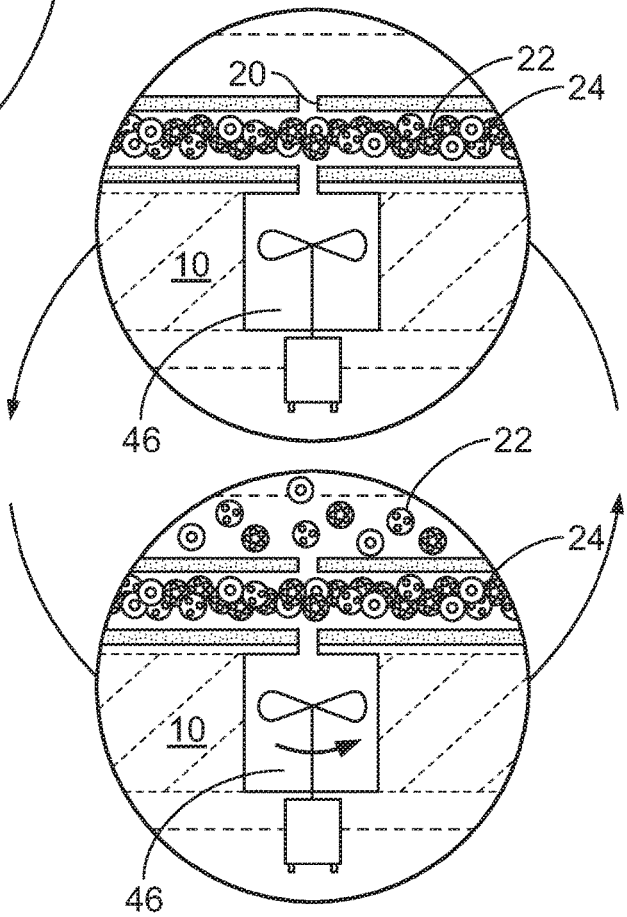
FIG. 10 illustrates a detail view of an embodiment of the dispensing device with a powered dispensing mechanism.

Referring to FIG. 10, a detail view of an embodiment of the dispensing device with a powered dispensing mechanism is shown.

When actuated by the user 100, a timer, or other means, the powered dispenser 46 pushes air upward, carrying microcapsules 22 from the reservoir 24 out through orifice 22.

Figure 11:
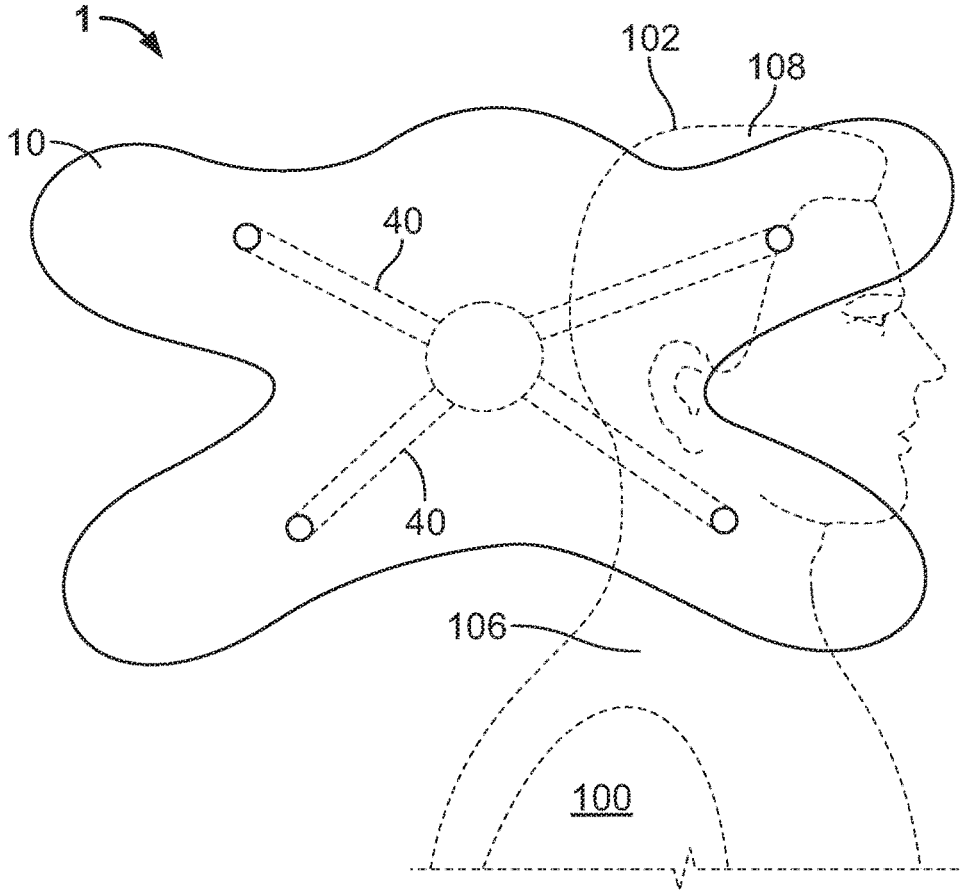
FIG. 11 illustrates an embodiment of the dispensing device with extensions to reduce pressure on the skin around the eyes and mouth.
Figure 12:
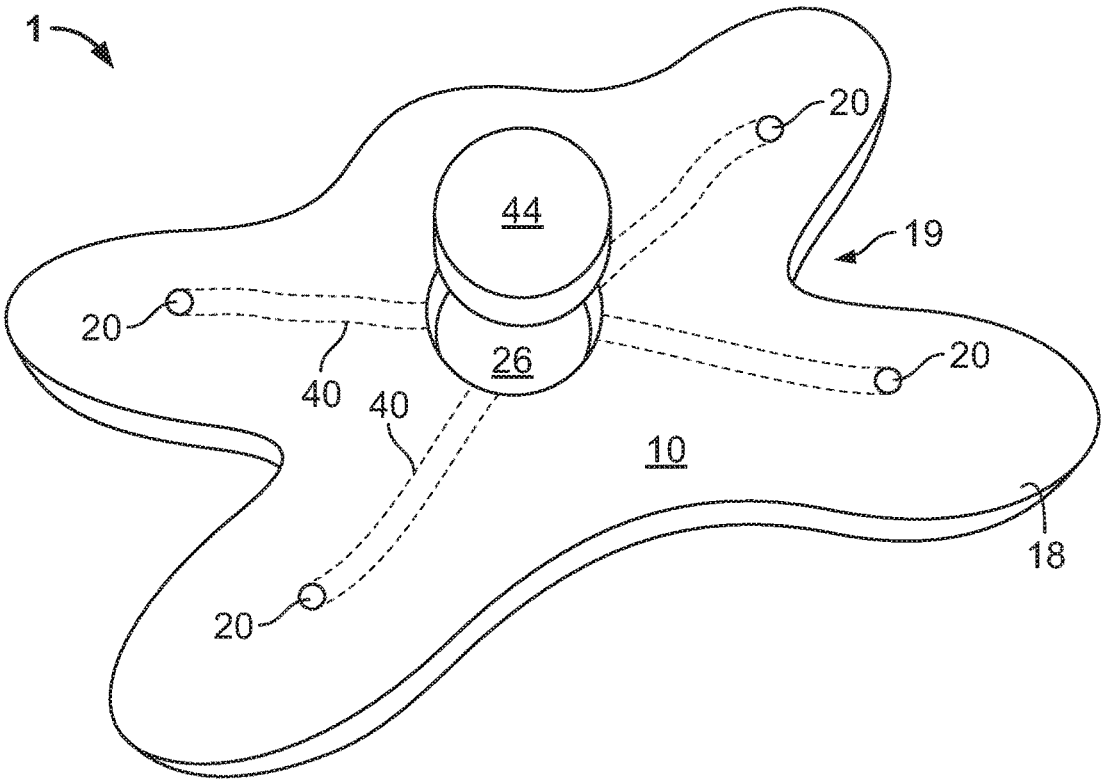
FIG. 12 illustrates a second view of an embodiment of the dispensing device with extensions to reduce pressure on the skin around the eyes and mouth.

Referring to FIGS. 11 and 12, an embodiment of the dispensing device with extensions to reduce pressure on the skin around the eyes and mouth is shown.

The dispensing device 1 is shown with body 10 include extensions 18. Between the extensions 18 are gaps 19. When in use, the user 100 places his head 102 on the extensions 18, causing the mechanical dispenser 44 to press against the storage body 26, causing the discharge of microcapsules through the branches 40 to the orifices 20. The microcapsules exit at the neck 106 and hair 108 of the user 100.

The gap 19 is placed such that pressure is reduced against the skin around the eyes and mouth of the user 100, thus preventing unnecessary stretching of the associated skin.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A pillow for application of nourishing compounds to a user's face, specifically skin of the user's face, the pillow comprising:

a pillow body;

a dispensing layer affixed to the pillow body;

the dispensing layer having a surface facing the user;

two or more reservoirs surrounded by the dispensing layer, the two or more reservoirs containing microcapsules;

the microcapsules being a membrane surrounding a skin-nourishing chemical;

the two or more reservoirs connected by a branch;

the branch carrying the microcapsules between the two or more reservoirs;

each of the two or more reservoirs including one or more orifices;

compression of the two or more reservoirs causing the discharge of microcapsules through the dispensing layer via the surface facing the user.

2. The pillow of claim 1, wherein the one or more orifices are strategically located to correspond with a cheek or a forehead of the user's skin during use.

3. The pillow of claim 1, wherein the dispensing layer further comprises:

two or more recesses, each of the two or more reservoirs fitted within a matching recess of the two or more recesses.

4. The pillow of claim 1, further comprising:

a mechanical bellows that discharges air when actuated by weight of the user;

the mechanical bellows connected to the two or more reservoirs;

whereby air discharged by the mechanical bellows passes through the one or more reservoirs, causing the discharge of nourishing compounds through the one or more orifices.

5. The pillow of claim 1, further comprising:

an electric fan that discharges air;

a discharge of the electric fan connected to the two or more reservoirs;

whereby air discharged by the electric fan passes through the one or more reservoirs, causing the discharge of nourishing compounds through the one or more orifices.

6. A pillow that dispenses microcapsules when laid upon by a user, the pillow comprising:

a pillow body;

a dispensing layer affixed to the pillow body;

a reservoir of microcapsules surrounded by the dispensing layer;

the microcapsules being a membrane surrounding a skin-nourishing chemical;

the microcapsules exiting the reservoir when a weight of the user creates a force against the dispensing layer;

the microcapsules exiting the reservoir away from the pillow body;

whereby the reservoir of microcapsules contains the microcapsules, dispensing when pressure created by the user is applied.

7. The pillow of claim 6, the reservoir further comprises:

orifices, the orifices controlling the location of discharge of the microcapsules.

8. The pillow of claim 6, wherein the dispensing layer further comprises:

a recess;

the reservoir sitting within the recess.

9. The pillow of claim 6, further comprising:

a mechanical bellows that discharges air when actuated by weight of the user;

the mechanical bellows connected to the reservoir;

whereby air discharged by the mechanical bellows passes through the reservoir, causing the discharge of microcapsules.

10. A compressible device with integrated microcapsule reservoirs, the device comprising:

a body;

a discrete and removable reservoir for storage of microcapsules, the discrete and removable reservoir surrounded by the body and removeable from the body;

a second reservoir;

the discrete and removable reservoir and second reservoir connected by a branch;

the branch carrying microcapsules from the reservoir to the second reservoir when a force is applied to the reservoir; and an actuation mechanism for discharge of the microcapsules through orifices present in the reservoirs.

11. The device of claim 10, wherein the orifices are strategically located to correspond with a cheek or a forehead of a user during use.

12. The device of claim 10, wherein the body further comprises:

a recess;

the discrete and removable reservoir sitting within the recess.

13. The device of claim 10, further comprising:

a mechanical bellows that discharges air when actuated by weight of a user;

the mechanical bellows connected to the discrete and removable reservoir;

whereby air discharged by the mechanical bellows passes through the reservoir, causing the discharge of microcapsules.

14. The device of claim 10, further comprising:

an electric fan that discharges air;

a discharge of the electric fan connected to the reservoir;

whereby air discharged by the electric fan passes through the reservoir, causing the discharge of microcapsules.

15. The device of claim 10, wherein the body further comprises:

two or more extensions separated by a gap;

each extension of the two or more extensions including an associated orifice connected to the discrete and removable reservoir by an associated branch;

wherein application of pressure to the actuation mechanism causes microcapsules to flow through the associated branches and exit the associated orifices;

whereby the gap limits pressure against skin around a user's eyes during use of the device.

* * * * *